US006523365B2

(12) United States Patent
Zhang et al.

(10) Patent No.: US 6,523,365 B2
(45) Date of Patent: Feb. 25, 2003

(54) ACCUMULATOR WITH INTERNAL HEAT EXCHANGER

(75) Inventors: Chao A. Zhang, Canton, MI (US); Henry Mehraban, Northville, MI (US); Richard G. Gibbons, Jr., Fraser, MI (US); Teodor Urdea, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/752,419

(22) Filed: Dec. 29, 2000

(65) Prior Publication Data

US 2002/0083733 A1 Jul. 4, 2002

(51) Int. Cl.[7] ..... F25B 43/00; F25B 41/00
(52) U.S. Cl. ..... 62/503; 62/513
(58) Field of Search ..... 62/503, 513

(56) References Cited

U.S. PATENT DOCUMENTS

| | | | | |
|---|---|---|---|---|
| 2,136,086 | A | * | 11/1938 | Rosenblad |
| 2,136,153 | A | * | 11/1938 | Rosenblad |
| 2,467,078 | A | | 4/1949 | Cahenzli, Jr. |
| 3,830,077 | A | * | 8/1974 | Willen et al. |
| 3,955,375 | A | * | 5/1976 | Schumacher |
| 4,208,887 | A | | 6/1980 | Morse et al. |
| 4,217,765 | A | * | 8/1980 | Ecker |
| 4,287,724 | A | * | 9/1981 | Clark |
| 4,474,035 | A | * | 10/1984 | Amin et al. ..... 626/503 |
| 4,488,413 | A | * | 12/1984 | Bottum |
| 4,602,674 | A | * | 7/1986 | Eriksson |
| 4,679,621 | A | * | 7/1987 | Michele |
| 5,245,833 | A | * | 9/1993 | Mei et al. |
| 5,289,699 | A | * | 3/1994 | Nivens |
| 5,457,966 | A | * | 10/1995 | Nivens |
| 5,479,790 | A | * | 1/1996 | Bottum et al. ..... 62/503 |
| 5,544,498 | A | * | 8/1996 | Benedict |
| 5,562,157 | A | * | 10/1996 | Hasegawa et al. |
| 5,609,036 | A | * | 3/1997 | Nagasawa et al. |
| 5,622,055 | A | * | 4/1997 | Mei et al. |
| 5,660,058 | A | * | 8/1997 | Harris et al. |
| 5,678,419 | A | * | 10/1997 | Sanada et al. |
| 5,678,422 | A | * | 10/1997 | Yoshii et al. |
| 6,032,482 | A | * | 3/2000 | Krauss ..... 62/513 |
| 6,062,039 | A | * | 5/2000 | Haramoto et al. |

FOREIGN PATENT DOCUMENTS

| | | | |
|---|---|---|---|
| EP | 0 424 474 B2 | * | 5/1991 |
| EP | 0 604 417 B1 | * | 7/1994 |
| EP | 0 837 291 A2 | * | 4/1998 |
| EP | 837 291 A2 | * | 4/1998 |
| GB | 2 316 738 A | * | 3/1998 |
| SE | 102 545 | * | 9/1941 |
| SE | 106 617 | * | 2/1943 |

* cited by examiner

*Primary Examiner*—William C. Doerrler
(74) *Attorney, Agent, or Firm*—Brinks Hofer Gilson & Lione

(57) ABSTRACT

An accumulator with an internal heat exchanger for use in an air conditioning or refrigeration system having a compressor, a condenser, an expansion device, and an evaporator is disclosed. In operation, the accumulator is placed in the system so high pressure, high temperature refrigerant flowing from the condenser and low pressure, low temperature refrigerant flowing from the evaporator simultaneously enter and flow through the heat exchanger disposed in the accumulator whereby the low pressure, low temperature refrigerant absorbs heat and thereby cools the high pressure, high temperature refrigerant. In one embodiment, the heat exchanger comprises a tube having at least one high temperature channel and one low temperature channel extending through the interior of the tube. In a second embodiment, the heat exchanger comprises a single spirally wound coaxial tube having an outer tube and an inner tube positioned within the outer tube. In a third embodiment, the heat exchanger comprises a plurality of coaxial tubes, each coaxial tube having an outer tube and an inner tube positioned in the outer tube wherein the inner tubes are fluidly connected.

14 Claims, 11 Drawing Sheets

ACCUMULATOR WITH INTERNAL HEAT EXCHANGER

BACKGROUND OF THE INVENTION

This invention relates to an accumulator with an integral heat exchanger for use in an air conditioning or refrigeration system. In particular, the heat exchanger is positioned inside the accumulator such that liquid refrigerant from the high pressure, high temperature side of the system and gaseous refrigerant from the low pressure, low temperature side of system simultaneously flow through the heat exchanger in a heat exchange relationship. The accumulator of the present invention may be used with a variety of refrigerants including R134*a* and carbon dioxide, despite the higher operating pressures inherent in a system using carbon dioxide as the refrigerant.

A basic refrigeration or air conditioning system has a compressor, a condenser, an expansion device, and an evaporator. These components are generally serially connected via conduit or piping and are well known in the art. During operation of the system, the compressor acts on relatively cool gaseous refrigerant to raise the temperature and pressure of the refrigerant. From the compressor, the high temperature, high pressure gaseous refrigerant flows into the condenser where it is cooled and exits the condenser as a high pressure liquid refrigerant. The high pressure liquid refrigerant then flows to an expansion device, which controls the amount of refrigerant entering into the evaporator. The expansion device lowers the pressure of the liquid refrigerant before allowing the refrigerant to flow into the evaporator. In the evaporator, the low pressure, low temperature refrigerant absorbs heat from the surrounding area and exits the evaporator as a saturated vapor having essentially the same pressure as when it entered the evaporator. The suction of the compressor then draws the gaseous refrigerant back to the compressor where the cycle begins again.

In a typical air conditioning or refrigeration system, it is necessary to prevent liquid from passing from the evaporator into the compressor in order to avoid damage to the compressor. When liquid refrigerant enters a compressor, it is known as slugging. Slugging reduces the overall efficiency of the compressor and can also damage the compressor. It is well known in the art to mount a suction line or low pressure side accumulator between the evaporator and compressor. Such suction line accumulators act to separate the liquid and gaseous phases of the refrigerant flowing from the evaporator. The liquid portion of the refrigerant will settle to the bottom of the accumulator while the gaseous phase will rise to the top of the accumulator and will be suctioned out of the accumulator by the compressor.

It is also known in the art to have an accumulator with a heat exchanger arranged on both the high pressure and low pressure sides of an air conditioning or refrigeration system. FIG. 1 is a schematic of a system having an accumulator arranged on both the high pressure and low pressure sides of the system. In general, high pressure, high temperature refrigerant exits a compressor 1 and flows into a condenser 3. The high temperature liquid refrigerant exits the condenser and flows into a heat exchanger located in an accumulator 5. The refrigerant is discharged from the accumulator and flows into an expansion device 7 and subsequently into an evaporator 9.

At the same time, low temperature, low pressure refrigerant flowing from the evaporator 7 enters the accumulator and the liquid phase settles to the bottom of the accumulator, and the gaseous phase rises. The low temperature gaseous refrigerant then flows through the heat exchanger where it comes in contact with the high pressure, high temperature liquid refrigerant from the condenser in a heat exchange relationship. The high pressure liquid from the condenser 3 is then cooled by the low pressure, low temperature gaseous refrigerant running simultaneously through the heat exchanger. As a result, the liquid refrigerant flowing from the condenser 3 to the evaporator is cooled and can thereby absorb more heat as it flows through the evaporator 7. The gaseous refrigerant exiting the low pressure side of heat exchanger is higher in temperature having absorbed heat from the high pressure, high temperature liquid refrigerant. As a result, any liquid refrigerant that may remain in the low pressure, low temperature refrigerant will be converted into a gas in the heat exchanger thereby reducing the risk of having liquid flow into the compressor.

U.S. Pat. Nos. 5,622,055, 5,245,833, 4,488,413, and 4,217,765 disclose accumulators with internal heat exchangers. In these patents, high pressure, high temperature refrigerant from the condenser is cooled as it flows through a tube that is sitting in a pool of low temperature liquid refrigerant that has been discharged from the evaporator and collected in the accumulator.

GB Patent No. 2316738B also discloses a low pressure side accumulator with an internal heat exchanger. The accumulator is divided into an upper and lower chamber. The heat transfer unit, two serially connected tubes, is housed in the lower chamber. High temperature, high pressure refrigerant flowing from the condenser enters one end of the tubes and exits the other end and then flows to an expansion device evaporator. At the same time, low pressure, low temperature refrigerant from the evaporator is discharged into the upper chamber. The refrigerant in the upper chamber is drawn into the lower chamber where it flows through the lower chamber in a heat exchange relationship with high pressure, high temperature refrigerant flowing through the tubes before being discharged from the accumulator and drawn back to the compressor.

U.S. Pat. Nos. 5,457,966 and 5,289,699 disclose a high pressure side accumulator with internal heat exchanger. In one embodiment, the heat exchanger comprises an outer shell with right and left end plates and an outer tube with a cutaway portion located within the shell. An inner tube is housed within the outer tube and extends through the shell and both end plates. In operation, high pressure, high temperature liquid refrigerant from the condenser enters an inlet line, which flows into the outer tube. The liquid refrigerant flows through the outer tube and into the shell at the cut away portion. The liquid refrigerant is discharged from the shell through an outlet line. At the same time, low pressure, low temperature refrigerant from the evaporator enters the smaller tube and flows through the inner tube in a heat exchange relationship with the high pressure, high temperature refrigerant before flowing back to the compressor.

In a second embodiment, the heat exchanger housed within the shell comprises a small oval shaped tube affixed to one side of a large tube. The larger tube extends through the entire length of the shell. High pressure, high temperature liquid refrigerant from the condenser enters one end of the oval shaped tube and exits the other end and flows into the shell. Liquid refrigerant exits the shell through an outlet line and flows to the evaporator. Simultaneously, low pressure, low temperature refrigerant flows from the evaporator through the large tube in a heat exchange relationship with the high pressure, high temperature refrigerant. The low pressure, low temperature refrigerant exiting the larger tube flows back to the compressor. A third embodiment is similar to the second embodiment except that the smaller tube is spirally wrapped around the outside of the larger tube.

U.S. Pat. No. 3,830,077 discloses a heat exchanger for use in a vehicle, which is connected between the evaporator and compressor. The heat exchanger comprises an outer shell with low pressure, low temperature inlet and outlet lines and at least one heat exchange coil, with an inlet end an outlet end both extending through the shell. In operation, low pressure, low temperature refrigerant enters the inlet line, flows through the shell, exits the outlet line and flows back to the compressor. At the same time a high temperature vehicle fluid flows through the coil in a heat exchange relationship with the low temperature, low pressure refrigerant. The patent does not specifically disclose connecting the heat exchange coil to the high pressure, high temperature side of the air conditioning system.

Finally, published EP Patent Application No. EP 0837291A2 discloses the use of a sub cooling circuit to cool high pressure, high temperature carbon dioxide refrigerant in a vehicle air conditioning system. The sub cooling circuit is located between the condenser and main expansion device and comprises a subpressure reducer and a heat exchanger. In operation, the high pressure, high temperature carbon dioxide refrigerant from the condenser is split into two flows, the first flow flows into the sub cooling circuit where it is cooled by passing through the pressure reducer before flowing through heat exchanger. The second flow of refrigerant passes directly through the heat exchanger where it is cooled by the first flow.

The application discloses two different types of heat exchangers. The first heat exchanger comprises a double circular tube structure which has an inner tube surrounded by an outer tube with fins separating the tubes. Lower temperature carbon dioxide refrigerant flows through the inner tube in a heat exchange relationship with higher temperature refrigerant flowing through the outer tube.

The second heat exchanger comprises a spiral tube structure formed from two tubes soldered together. Each tube is an extruded aluminum strip with an upper row of holes and a lower row of holes. High temperature carbon dioxide refrigerant flows through both rows of holes in one tube while lower temperature refrigerant flows through both rows of holes in the second tube in a heat exchange relationship. EP Patent Application No. 0837291A2 does not disclose having high temperature and low temperature refrigerant flowing through one tube at the same time.

Furthermore, EP Patent Application No. 0837291A2 does not disclose combining the heat exchanger in the sub cooling circuit into an accumulator. Thus, the disclosed air conditioning system is more complicated than necessary having an extra sub cooling circuit, which can be eliminated by the present invention.

While the above accumulators and heat exchangers are suitable for their intended purpose, it is believed that there is a demand in the industry for an improved accumulator with an internal heat exchanger, especially one that can withstand the higher pressure requirements of an air conditioning or refrigeration system employing carbon dioxide as a refrigerant. It is further believed that there is a demand for an improved accumulator with an internal heat exchanger that is compact, easily assembled, lighter weight, and less costly to manufacture, but yet provides a high level of efficiency.

BRIEF SUMMARY OF THE INVENTION

The present invention provides an improved accumulator for use in an air conditioning or refrigeration system, and in particular, provides an accumulator with an improved compact heat exchanger. The improved accumulator may be used in existing air conditioning and refrigeration systems utilizing R134*a* as the refrigerant as well as in newer systems utilizing carbon dioxide as the refrigerant. The improved accumulator can easily withstand the higher pressures resulting from the use of carbon dioxide refrigerant.

The improved heat exchanger has a high heat transfer efficiency resulting in an increase in the coefficient of performance (COP) for the air conditioning or refrigeration system. As a result, the air conditioning or refrigeration system has greater cooling capacity. This greater cooling capacity allows for more rapid "pull down" or cooling when the air conditioning or refrigeration system is first started.

In addition, the accumulator of the present invention provides increased protection against slugging in the compressor by ensuring that any liquid remaining in the refrigerant being drawn back into the compressor is vaporized in the heat exchanger. Finally, the heat exchanger of the present invention is easy to manufacture and is lighter in weight because all of the components may be made from aluminum.

According to one embodiment of the present invention, the accumulator has a housing with a top and a bottom such that the housing, top, and bottom form a chamber. The accumulator has a high pressure outlet port and a low pressure inlet port extending through the top and into the chamber, and a high pressure inlet port and a low pressure outlet port which are external to the housing. A vapor conduit tube and a heat exchanger are disposed in the chamber. The heat exchanger comprises at least one tube having a low temperature channel and a high temperature channel, each channel extending through the interior of the tube. At one end of the tube, the high temperature channel is connected to the high pressure inlet port and the low temperature channel is connected to the low pressure outlet port. At the other end of the tube, the high temperature channel is connected to the high pressure outlet port and the low temperature channel is connected to the vapor conduit tube.

In operation, high pressure, high temperature refrigerant from the condenser enters the accumulator and then the heat exchanger through the high pressure inlet port. The high pressure, high temperature refrigerant flows through the high temperature channel and exits the heat exchanger and the accumulator through the high pressure outlet port. Simultaneously, low pressure, low temperature refrigerant flows through the low temperature inlet port into the chamber and is conveyed through the vapor conduit tube to the heat exchanger. The low pressure, low temperature refrigerant then flows through the low temperature channel in a heat exchange relationship with the high pressure, high temperature refrigerant flowing through high temperature channel thereby cooling the high pressure, high temperature refrigerant.

In a second embodiment of the present invention, the accumulator likewise has a housing with a top and bottom such that the housing, top and bottom form an internal chamber. High pressure, high temperature inlet and outlet ports as well as low temperature inlet and outlet ports extend through the top of the accumulator into the chamber. A vapor conduit tube and a heat exchanger are disposed in the chamber. The heat exchanger comprises a coaxial tube having an outer tube and an inner tube disposed within the outer tube. At one end of the coaxial tube, the high pressure, high temperature inlet port is attached to the inner tube and the low pressure, low temperature outlet port is attached to the outer tube. At the other end of the coaxial tube the high pressure, high temperature outlet port is attached to inner tube and the vapor conduit tube is attached to the outer tube.

In operation, high pressure, high temperature refrigerant from the condenser enters the accumulator and then the heat exchanger through the high pressure inlet port. The high pressure, high temperature refrigerant flows through the inner tube and exits the heat exchanger and the accumulator through the high pressure outlet port. Simultaneously, low pressure, low temperature refrigerant flows through the low temperature inlet port into the chamber and is conveyed through the vapor conduit tube to the heat exchanger. The low pressure, low temperature refrigerant then flows through the outer tube in a heat exchange relationship with the high pressure, high temperature refrigerant flowing through the inner tube thereby cooling the high pressure, high temperature refrigerant.

In a third embodiment of the present invention, the accumulator has a housing, a top, and a bottom such that the housing, top, and bottom form a chamber. The chamber is divided into an upper chamber and a lower chamber by a separator. The accumulator further has low pressure inlet port and a vapor conduit extending through the top, the upper chamber and the separator before terminating in the lower chamber. The internal heat exchanger comprises a plurality of coaxial tubes, each coaxial tube having an outer tube and an inner tube disposed within the outer tube. The inner tubes of the coaxial tubes extend through the top, upper chamber, separator, lower chamber and bottom of the accumulator. The outer tubes extend from the top in the upper chamber through the separator and terminate in the lower chamber. The inner tubes are interconnected to allow refrigerant to circulate through each inner tube.

In operation, the high pressure, high temperature refrigerant flows from the condenser and enters the connected inner tubes. The refrigerant flows through the tubes before being discharged from the accumulator. At the same time, low pressure, low temperature refrigerant from the evaporator enters the low pressure inlet port and flows into the accumulator. The low pressure, low temperature refrigerant then flows through the outer tubes in a heat exchange relationship with the refrigerant flowing through the inner tubes and is deposited in the lower chamber.

The low pressure, low temperature refrigerant is then drawn into the vapor conduit tube and is discharged from the accumulator.

Further features and advantages of the present invention will be apparent upon reviewing the following detailed description and accompanying drawings.

DETAILED DESCRIPTION OF THE INVENTION

Figure 2:
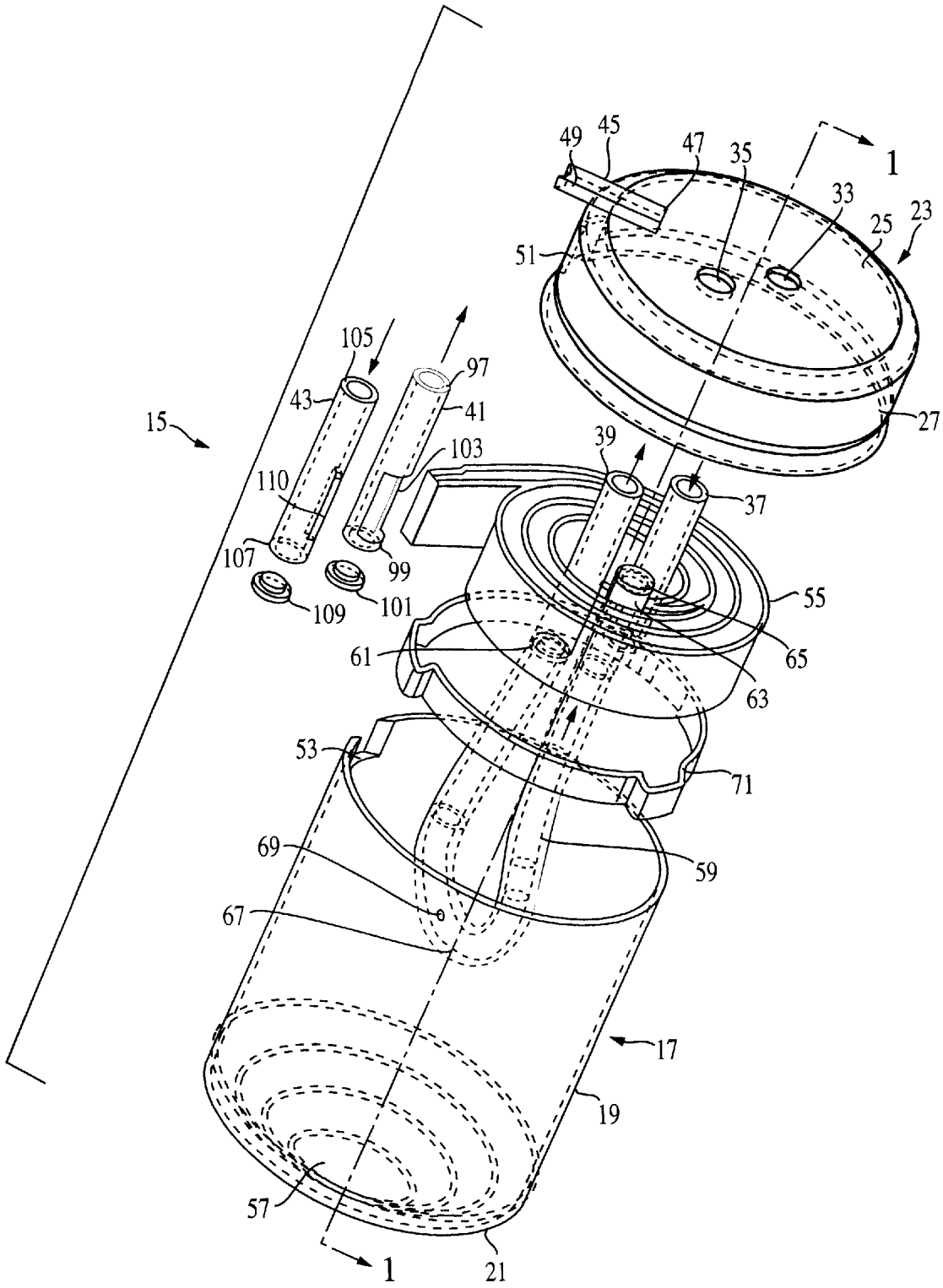
FIG. 2 is an exploded view of a first embodiment of an accumulator of the present invention.
Figure 3:
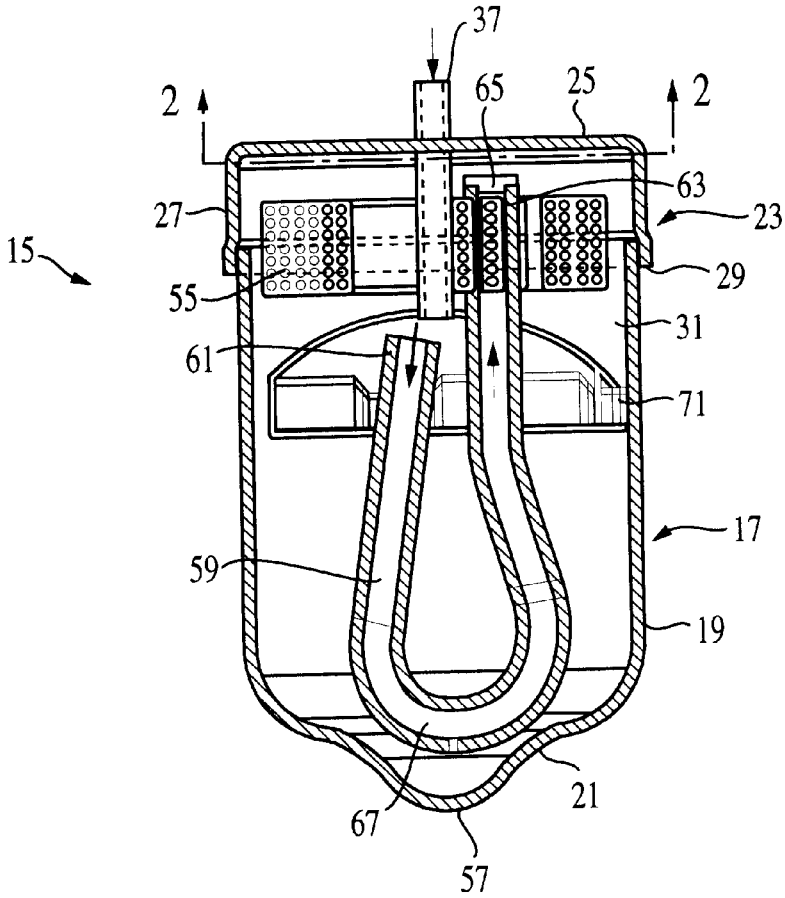
FIG. 3 is a cross-sectional view of the accumulator of FIG. 2 taken along line 1—1.

Referring to FIGS. 2 and 3, the accumulator 15 has a housing 17 with sidewalls 19, a bottom wall 21, and a cover 23 comprising a top 25 and sidewalls 27. The housing 17 and the bottom wall 21 are preferably integrally formed to form the lower portion of the accumulator. The cover 23 is separately formed from the housing and forms the upper portion of the accumulator. While the accumulator shown in FIGS. 2 and 3 is cylindrical in shape, the accumulator of the present invention may have any shape, including square, rectangular or ellipsoidal.

The housing 17 and the integrally formed bottom wall 21 are generally affixed to cover the 23 in an abutting relationship at an overlapping juncture 29 to form a fluid tight or sealed internal chamber 31. Welding, soldering, or brazing may be used to affix the housing and cover. The cover and housing may be formed from any material that will satisfy the structural demands placed on the accumulator. Suitable materials include, but are not limited to, aluminum, stainless steel, and copper. In a preferred embodiment, the accumulator cover and housing are aluminum.

The top of the cover has two openings 33 and 35 for receiving a low pressure inlet port 37 and a high pressure outlet port 39 respectively. The openings 33 and 35 may be circular, elliptical, square, rectangular, or any other desired shape. The low pressure inlet port 37 and high pressure outlet port 39 generally correspond in shape to the openings in the top of the cover. In a preferred embodiment, the openings 33 and 35 are circular and low pressure inlet port and high pressure outlet ports are cylindrical in shape.

In addition, the accumulator has a low pressure outlet port 41 and a high pressure inlet port 43. Preferably, high pressure inlet port and low pressure outlet port are cylindrical but may have any shape desired. The high pressure inlet and outlet ports and the low pressure inlet and out ports may be formed from aluminum, stainless steel, copper or any other suitable material. Preferably the inlet and outlet ports are formed from aluminum.

The low pressure outlet port is affixed to the outer portion of the sidewall 27 by brazing, soldering welding, or the like. The high pressure inlet port is supported by a support 45 mounted on the top of the cover. The support 45 is generally rectangular in shape with one end 47 affixed to the top of the cover, and the opposite end 49 affixed to the high pressure inlet port. The end 49 attached to the high pressure inlet port will generally conform to the shape of the port. As shown in FIG. 2, the high pressure inlet port 43 is cylindrical and thus the support has a circular shaped end, which conforms directly to the radius of curvature of the cylindrical port. The support may be attached to the cover and the high pressure outlet port by soldering, brazing, welding, or any other suitable method.

Below the support, an inverted U-shaped opening 51 is formed in the sidewall of the cover. The housing 17 has a corresponding U-shaped opening 53 in the upper portion of the sidewall 19. When the housing and the cover are affixed the opening 51 and the opening 53 align to from a generally rectangular opening through which a portion of a heat exchanger 55 passes and is connected to the low pressure outlet port 41 and the high pressure inlet port 43. The housing 17 further has a sump 57 formed in the center of the bottom wall 21. The sump 57 collects and stores oil, which is used to lubricate the components of the air conditioning or refrigeration system.

A vapor conduit 59 with a vapor inlet end 61 and a vapor outlet end 63 having a cap 65 is positioned inside the housing. Preferably, vapor the conduit is an aluminum cylindrical J-shaped tube or J-tube. However, the vapor conduit may have any other desirable shape, including linear, and may be formed from any suitable materials such as stainless steel or copper. The vapor outlet end 63 extends vertically into the lower portion of the housing and is curved at its lower most point 67. The curved portion of the J-tube extends into the housing adjacent the bottom wall. The J-tube 59 extends upwardly from the lower most point to the inlet end 61. The J-tube 59 further has one or more openings 69 in the curved portion of the tube, which allow small amounts of oil to be drawn out of the sump and into the J-tube where the oil is mixed with gaseous refrigerant. The refrigerant/oil mixture eventually exits the accumulator through the low pressure outlet port 41 and flows back to the compressor providing needed lubrication for the compressor and other components of the system. As shown in FIGS. 2 and 3, the accumulator may also have a deflector positioned in the housing. The deflector 71 assists in separating liquid and gaseous refrigerant entering the accumulator through the low pressure inlet port from the evaporator. Low pressure, low temperature refrigerant entering the accumulator comes into contact with the deflector causing any liquid refrigerant to flow down the sides of the accumulator thereby preventing liquid refrigerant from entering the inlet end 61 of the J-tube. Gaseous refrigerant rises and is allowed to enter the inlet end 61 of the J-tube, which is positioned underneath the deflector. The deflector can be made of any suitable material including aluminum, copper, stainless steel, or plastic, and may have a variety of shapes including conical, dome, disc or cup. In a preferred embodiment, the deflector is dome shaped and formed from aluminum. The deflector further has an opening through which the outlet end of the J-tube passes. The J-tube may be soldered, brazed or welded to the deflector at the point the outlet end passes through the deflector to from a liquid-tight seal.

Figure 5:
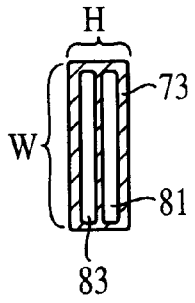
FIG. 5 is a cross-sectional view of one embodiment of a heat exchanger of the present invention.
Figure 6:
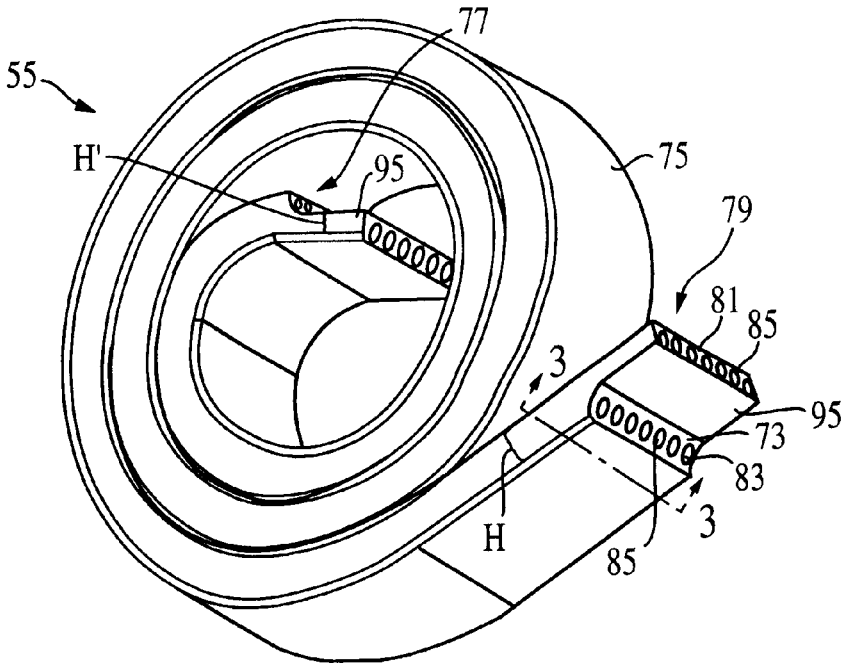
FIG. 6 is an elevational view of a heat exchanger of the present invention.
Figure 7:
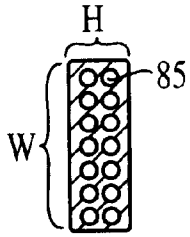
FIG. 7 is a cross-sectional view of the heat exchanger of FIG. 6 taken along line 3—3.
Figure 8:
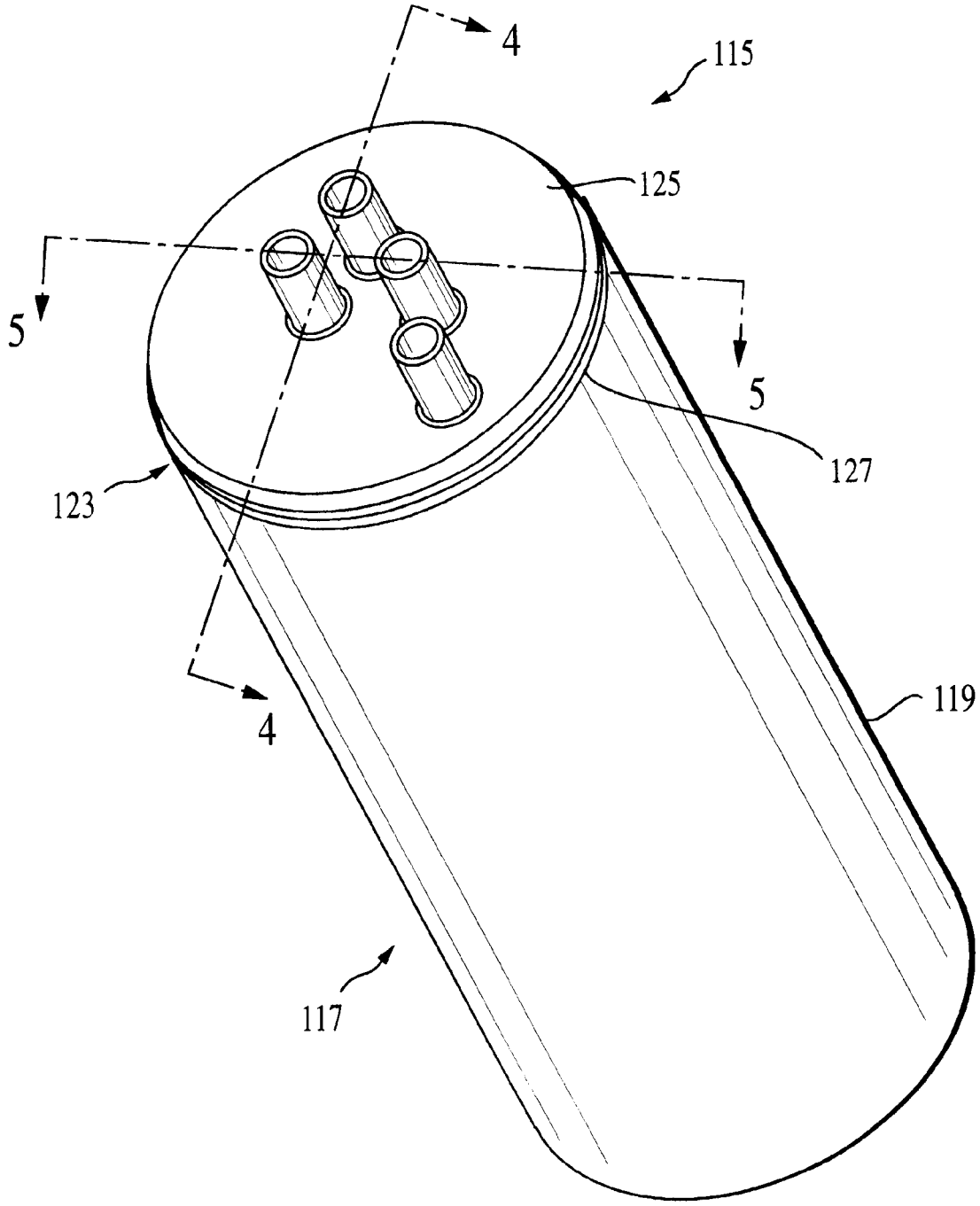
FIG. 8 is a plan view of a second embodiment of an accumulator of the present invention.
Figure 9:
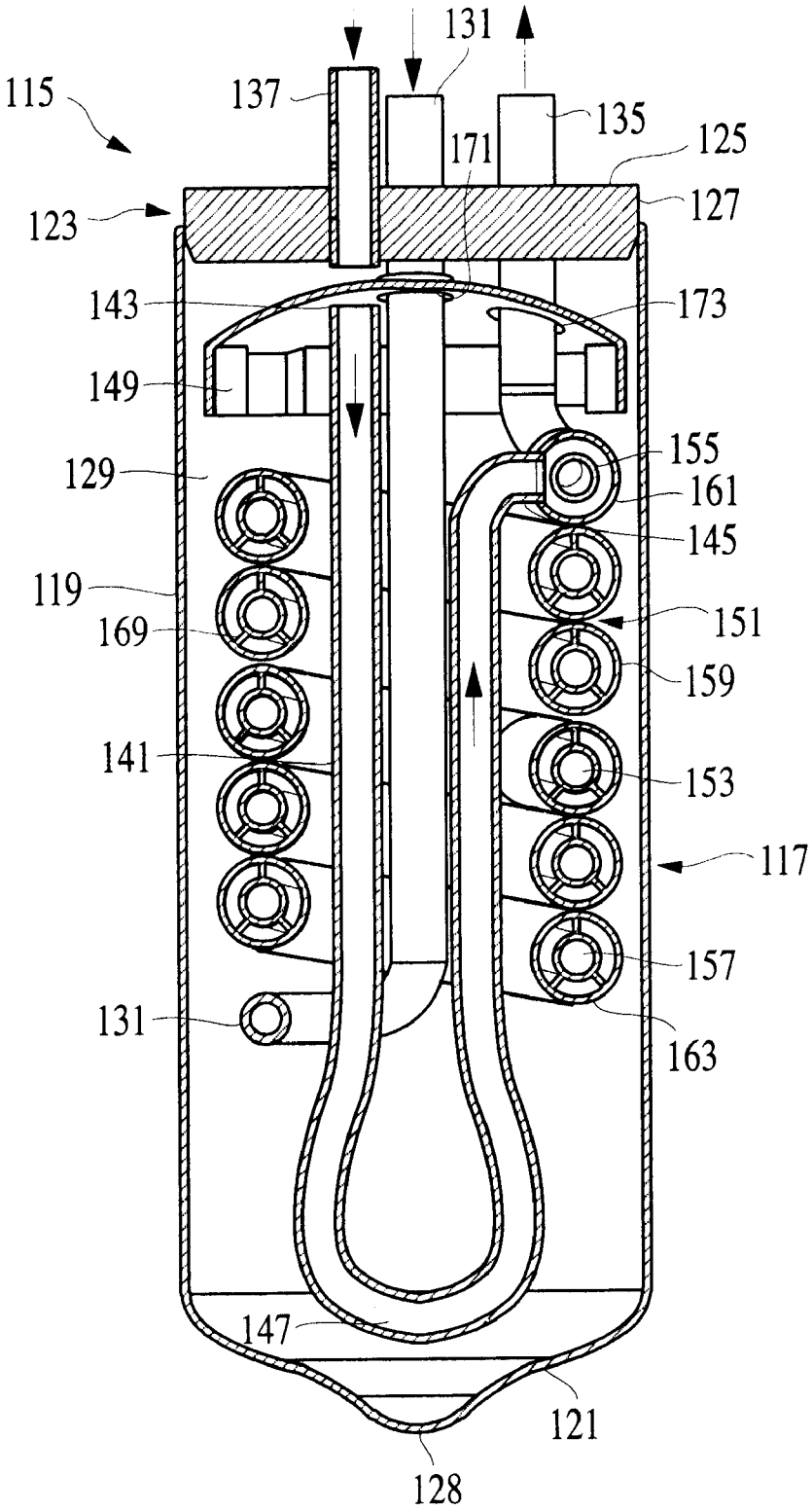
FIG. 9 is a cross-sectional view of the accumulator of FIG. 8 taken along line 4—4.

Referring now to FIG. 6, the heat exchanger 55 is formed separately from the accumulator cover and housing and is generally an extruded tube with interior 73, exterior 75, height H and width W. In a preferred embodiment, the heat exchanger is a rectangular shaped flat extruded aluminum tube. However, the tube may have any shape including circular or elliptical, and may be formed from any other suitable material such as stainless steel, copper or plastic. Preferably, the heat exchanger has a spiral configuration with an internal end 77 and an external end 79. As shown in FIG. 5, the heat exchanger 55 further has at least two adjacent channels, a high temperature channel 81 and a low temperature channel 83 extending through the interior 73 of the tube. As shown in FIGS. 6 and 7, the channels preferably comprise two rows of microchannels 85. In a preferred embodiment, a section of low temperature channel 83 is removed from the internal and external ends of the heat exchanger tube. As a result, the high temperature channel protrudes beyond the low temperature channel and forms a tongue 95 with height H' and width W on each end of the heat exchanger.

Alternatively, the heat exchanger may be an extruded tube having three or more channels, an upper channel, a middle channel and a lower channel. In such a heat exchanger, high pressure, high temperature refrigerant from the condenser may flow through the middle row of microchannels while low pressure, low temperature refrigerant from the evaporator flows through the upper and lower rows of microchannels in the opposite direction.

Figure 4:
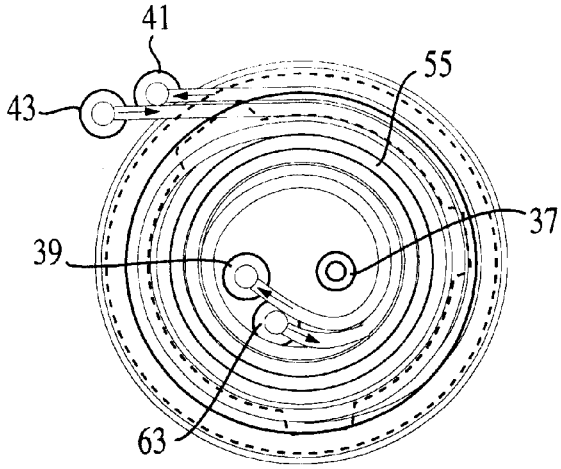
FIG. 4 is a top cross-sectional view of the accumulator of FIG. 3 taken along line 2—2.

FIG. 4 is a top sectional view of the heat exchanger having two rows of microchannels as it is positioned in the accumulator. The high pressure outlet port 39 and the vapor outlet end 63 of the J-tube are attached to the interior end of the heat exchanger. The low-pressure outlet port 41 and the high-pressure inlet port 43 are attached to the exterior end of the heat exchanger. The low-pressure inlet port 37 is not connected to the heat exchanger.

As shown in FIG. 2, low pressure outlet port 41 has an upper end 97 and a lower end 99 with a cap 101. The lower end 99 further has an opening 103 for receiving the low temperature channel of the heat exchanger tube. The opening 103 conforms generally to the height H and width W of the heat exchanger. The low pressure outlet port is attached to the heat exchanger by sliding the port over the tongue 95 and forming an abutting relationship with the low temperature channel. The J-tube 59 likewise has an opening in the outlet end 63 of the tube for receiving the heat exchanger. The opening in the upper end of the J-tube is identical to that of the low pressure outlet port, so the J-tube attaches to the heat exchanger in the same manner as the low pressure outlet port. Both the low pressure outlet port 41 and the J-tube 59 may be attached to the heat exchanger by soldering, brazing, welding, or any other suitable method.

High pressure inlet port 43 and high pressure outlet port 39 likewise have upper ends 105 and lower ends 107 with caps 109. High pressure inlet and outlet ports also have openings 110 in the lower end of the ports for receiving the heat exchanger. In general, the openings 110 conform to the width W and H" of the tongue 95, and are D-shaped. High pressure inlet and outlet ports are attached to the heat exchanger by inserting the tongues 95 into the openings 110. Both the high pressure inlet and outlet ports may be attached to the tongue by soldering, brazing, welding or any other suitable method.

Figure 1:
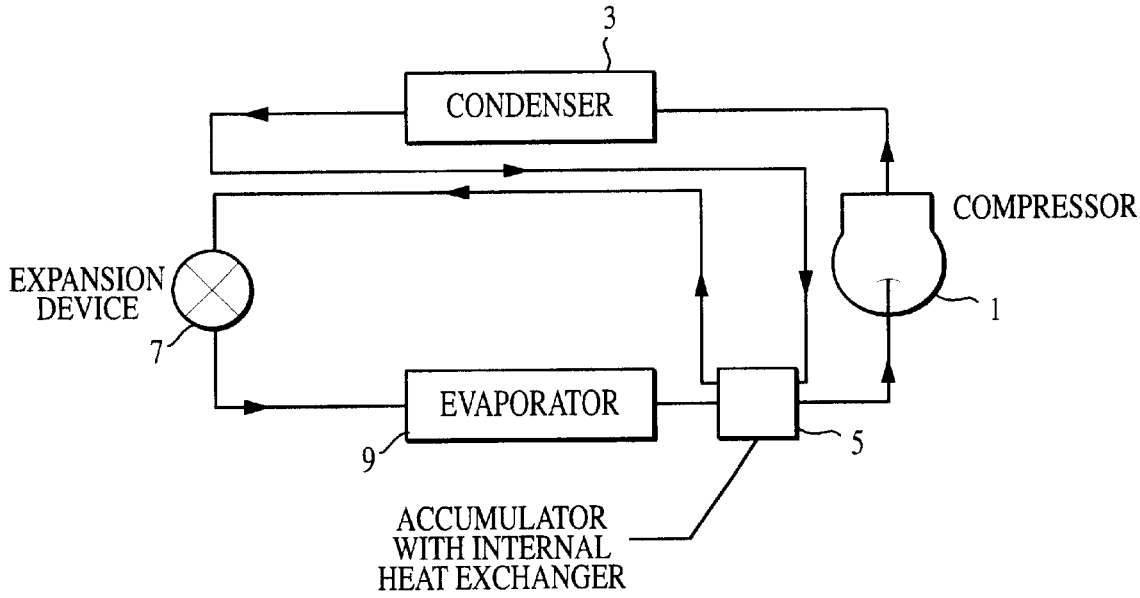
FIG. 1 is a schematic of an air conditioning system using the accumulator-heat exchanger of the present invention.

In operation, the accumulator 15 is placed into an air conditioning or refrigeration system as shown in FIG. 1. The refrigerant flow through the system is the same as discussed with respect to FIG. 1. Therefore, only. the flow through the accumulator will be specifically discussed. Arrows have been added to FIGS. 2–4 to illustrate the flow of refrigerant through the accumulator and the heat exchanger. From the condenser, the high temperature liquid refrigerant flows into the accumulator through the high pressure inlet port 43, and then into the heat exchanger 55 where it flows in a clockwise direction through the high temperature channel 81 before being discharged from the accumulator at the high pressure outlet port 39. After being discharged from the accumulator, the refrigerant flows to an expansion device, which meters the amount of fluid flowing into the evaporator. Simultaneously, the primarily gaseous refrigerant exits the evaporator and flows into the low pressure inlet port 37 of the accumulator. The refrigerant hits the dome shaped deflector 71, and any liquid refrigerant settles to the bottom of the accumulator. The gaseous refrigerant rises and enters the vapor inlet end 61 of the J-tube 59 and then flows through the J-tube and out the vapor outlet end 63 into the low temperature channel 83 of the heat exchanger. The low pressure, low temperature gaseous refrigerant flows in a counterclockwise direction through the low temperature channel of the heat exchanger where it absorbs heat from the high pressure, high temperature refrigerant passing through the high temperature channel. The low pressure, low temperature refrigerant vapor is then drawn out of the accumulator through the low pressure outlet port 41 and flows to the compressor.

A second embodiment of the accumulator of the present invention is shown in FIGS. 8–12. Referring to FIGS. 8–11, the accumulator 115 has a housing 117 with sidewalls 119, a bottom wall 121, and a cover 123 having a top 125 and sidewalls 127. The housing 117 and the bottom wall 121 are preferably integrally formed. Similar to the previous embodiment, a sump 128 is formed in the bottom wall of the housing in the housing. The sump 128 is similar in design to the sump previously discussed, and therefore, will not be discussed in further detail. The cover is separately formed from the housing and forms the upper portion of the accumulator. While the accumulator shown in FIGS. 8–11 is cylindrical in shape, the accumulator of the present invention may have any shape, including square, rectangular or ellipsoidal.

The cover 123 generally fits on top of the housing and integrally formed bottom wall 121 to form a fluid tight or sealed internal chamber 129. Welding, soldering, or brazing may be used to affix the housing and cover. The cover and housing may be formed from any material that will satisfy the structural demands placed on the accumulator. Suitable materials include, but are not limited to, aluminum, stainless steel, and copper. In a preferred embodiment, the accumulator cover and housing are aluminum.

Figure 10:
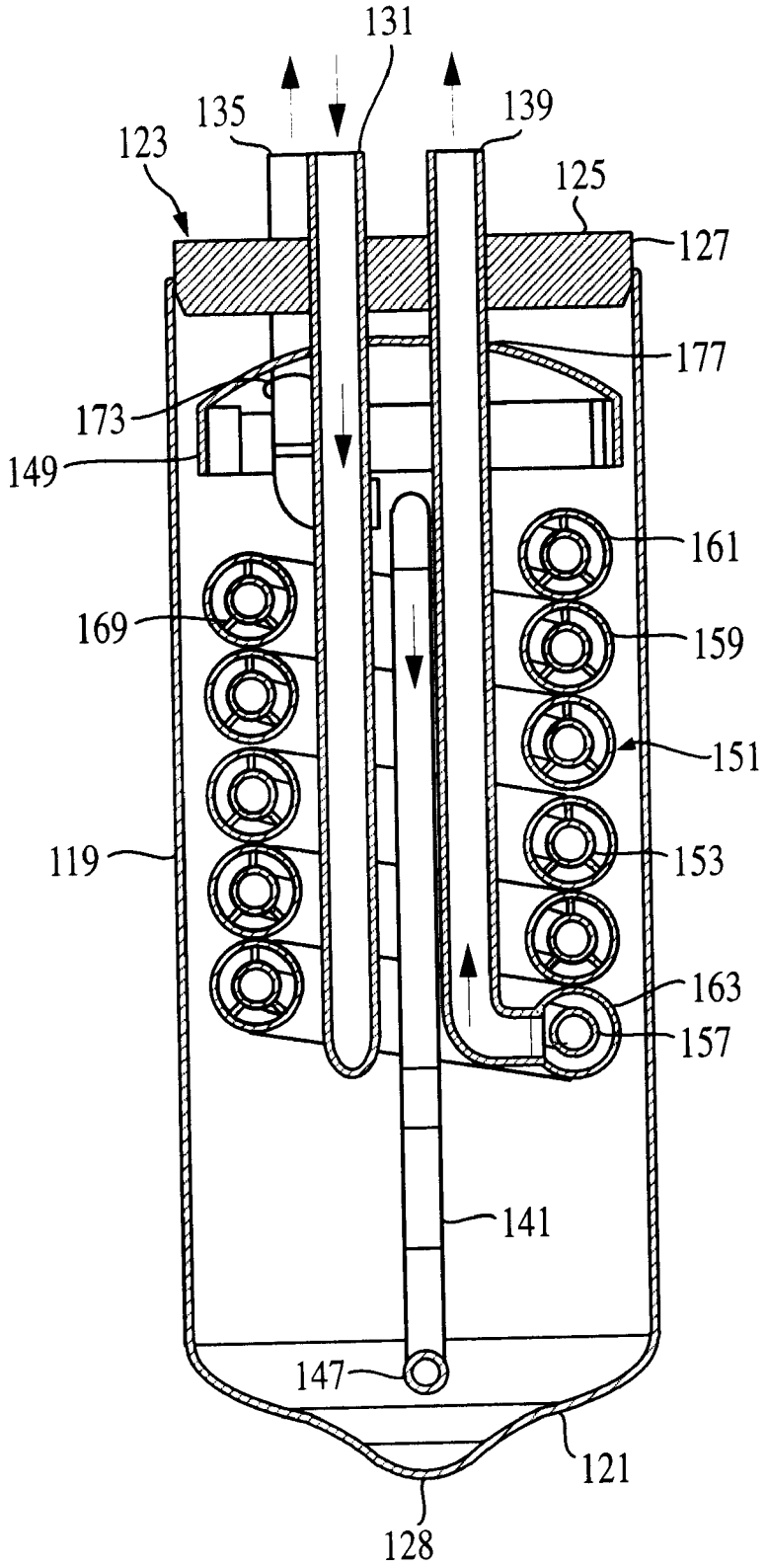
FIG. 10 is a cross-sectional view of the accumulator of FIG. 8 taken along line 5—5.
Figure 11:
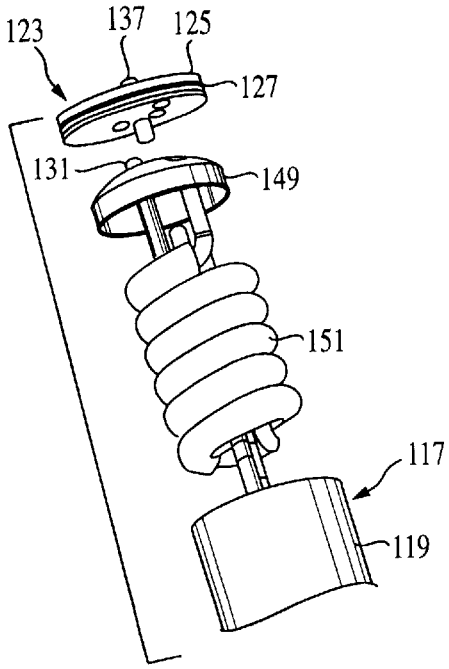
FIG. 11 is a partial exploded view of the second embodiment of the present invention.

As shown in FIGS. 10 and 11, the accumulator has a high pressure inlet port 131, a high pressure outlet port 135, a low pressure inlet port 137, and a low pressure outlet port 139. Referring to FIG. 10, the accumulator further has a vapor conduit or J-tube 141 with an inlet end 143 and an outlet end 145 positioned inside the housing. The inlet and outlet ports as well as the J-tube may have any desired shape, and may be formed from any suitable material including but not limited to aluminum, stainless, steel, or copper. Preferably inlet and outlet ports and J-tube are cylindrical in shape and are formed from aluminum.

The inlet end of the J-tube extends vertically into the lower portion of the housing and is curved at its lower most point 147. The J-tube extends upwardly from the lower most point to its outlet end 145. The J-tube 141 further has one or more openings (not shown) in the curved portion of the conduit to allow for lubricating oil to be drawn into the system as previously discussed with respect to the first embodiment. As shown in FIG. 10, both the inlet and outlet ends 143 and 145 of the J-tube are positioned underneath a dome shaped deflector 149. The deflector is similar to deflector 71 shown in FIGS. 2 and 3, and therefore, will not be discussed in further detail.

Figure 12:
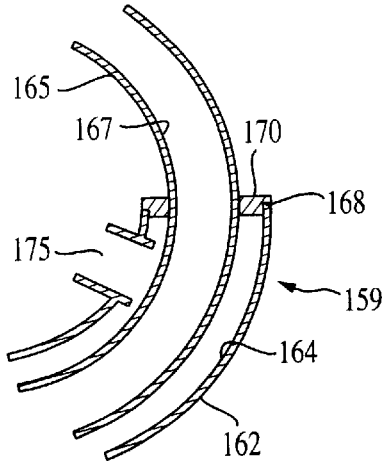
FIG. 12 is a cross-sectional view of one end of the heat exchanger of the second embodiment of the present invention.
Figure 13:
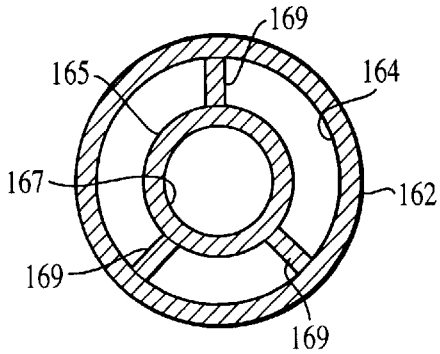
FIG. 13. is an enlarged cross-sectional view of a coaxial tube used in the heat exchanger of the second embodiment of the present invention.

A heat exchanger 151 is also disposed in the housing. Referring now to FIGS. 10–12, the heat exchanger comprises an extruded coaxial tube with an inner tube 153 having an upper end 155 and a lower end 157 and an outer tube 159 having corresponding upper and lower ends 161 and 163. As shown in FIG. 13, an enlarged cross-sectional view of the coaxial tube, the outer tube has an outer wall 162 and an inner wall 164, and the inner tube has outer wall 165 and inner wall 167. Fins or separators 169 extend radially from the outer wall 165 of the inner tube to the inner wall 164 of the outer tube. Any number of fins may be used separate the inner and outer tubes. However, the greater the number of fins, the more difficult it is to spirally shape the coaxial tube. While the coaxial tube in FIGS. 10–12 is preferably spirally shaped, the coaxial tube may be straight or have other configurations as desired. The inner and outer tubes as well as the fins may be formed from aluminum, copper, or stainless steel or any other suitable material. Preferably, the inner and outer tubes are aluminum.

As shown in FIG. 12, a cross-sectional view of each end of the coaxial tube, a portion of the upper and lower ends of the outer tube 159 is removed so that sections 166 of the inner tube extend beyond the upper and lower ends of the outer tube. A cap 170 is placed on each end 168 of the outer tube in order to seal the tube and prevent refrigerant from flowing out the ends.

Referring now to FIGS. 10 and 11, the high pressure inlet port 131 extends through the cover of the accumulator, passes through an opening 171 in the deflector and extends down into the housing where it is attached to the lower end of the inner tube. The high pressure outlet port 135 extends through the top of the accumulator, passes through an opening 173 in the deflector and is attached to the upper end 155 of the inner tube. Preferably, the high pressure inlet and outlet ports are cylindrical and have a diameter that is either slightly larger or slightly smaller than the diameter of the inner tube such that inner tube and high pressure inlet and outlet ports may be matingly engaged. Welding, soldering, brazing or any other suitable method may be used to form a permanent seal between the high pressure inlet and outlet ports and the lower and upper ends of the inner tube.

The J-tube 141 is attached at its outlet end 145 to the upper end 161 of the outer tube. As shown in FIG. 12, the outer tube has an opening 175 in the side of the upper and lower ends of the tube. The outlet end 145 of the J-tube has a diameter slightly less than the diameter of opening 175 and is capable of mating engagement with opening 175 of the outer tube. The outlet end of the J-tube and the upper end of the outer tube are soldered, brazed or welded together to form a liquid tight seal. The low pressure outlet port 139 extends through the top of the accumulator, passes through an opening 177 in the deflector and extends vertically into the lower portion of the housing. The low pressure outlet port 139 is attached to the lower end 163 of outer tube in the same manner the J-tube is attached to the outer tube.

In operation, the accumulator 115 is positioned in an air conditioning or refrigeration system as shown in FIG. 1. Again, the flow of refrigerant through the system is the same as discussed with respect to FIG. 1. Arrows have been added to FIGS. 10 and 11 to indicate the direction of flow of the refrigerant through the accumulator. Therefore, only the flow through the accumulator will be discussed. High pressure, high temperature liquid refrigerant from the condenser enters the high pressure inlet port 131 of the accumulator and flows through the inner tube 153 of the heat exchanger in a counter-clockwise direction. The high pressure, high temperature refrigerant is then discharged from the accumulator through high pressure outlet port 135. At the same time, low pressure, low temperature refrigerant exiting the evaporator enters the accumulator through the low pressure inlet port 137 contacts the deflector 149 and flows into the accumulator housing. The gaseous refrigerant rises and enters the inlet end 143 of the J-tube and flows into the upper end 161 of the outer tube. The low temperature, low pressure refrigerant flows through the outer tube in a clockwise direction absorbing heat from the high pressure, high temperature refrigerant, thereby lowering the temperature of the high pressure, high temperature refrigerant. The low pressure, low temperature refrigerant is discharged from the accumulator through the low pressure outlet port 139 and drawn back to the compressor.

Figure 14:
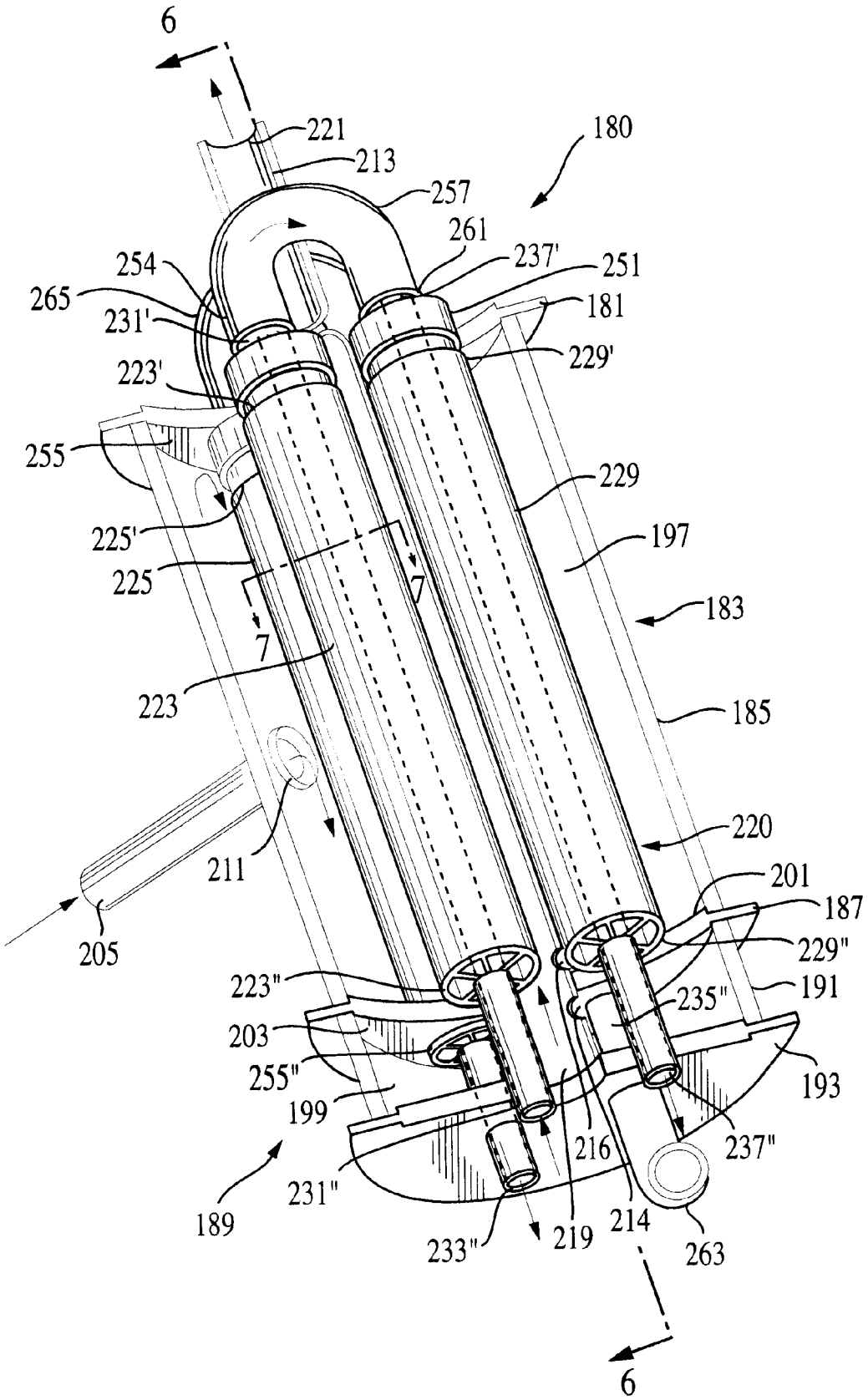
FIG. 14 is a cut-away view of a third embodiment of an accumulator of the present invention.
Figure 15:
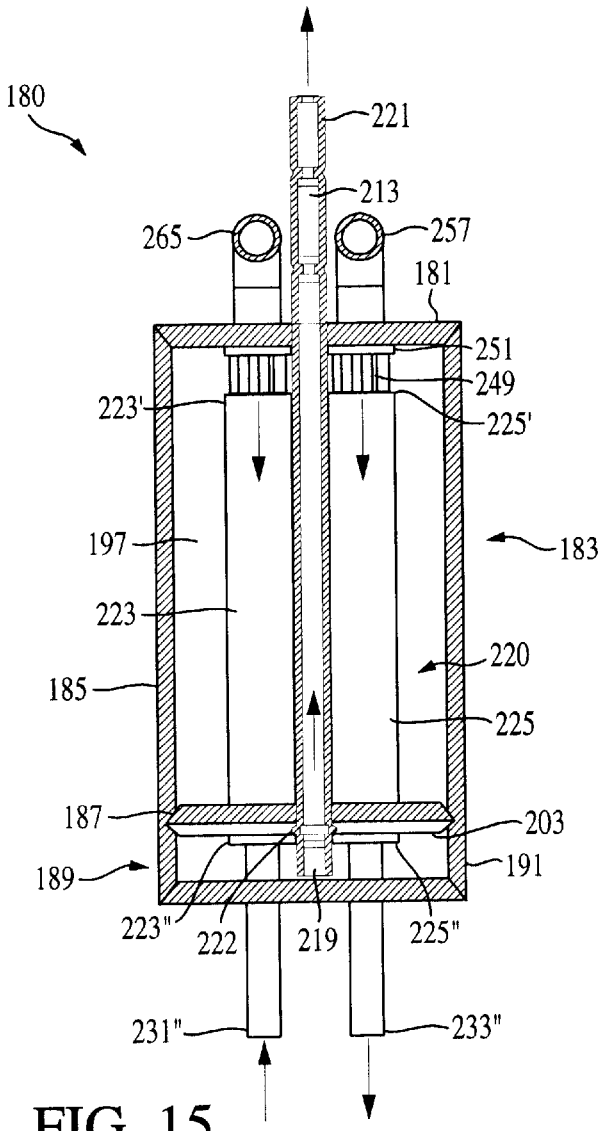
FIG. 15 is a cross-sectional view of the accumulator of FIG. 14 taken along line 6—6.
Figure 16:
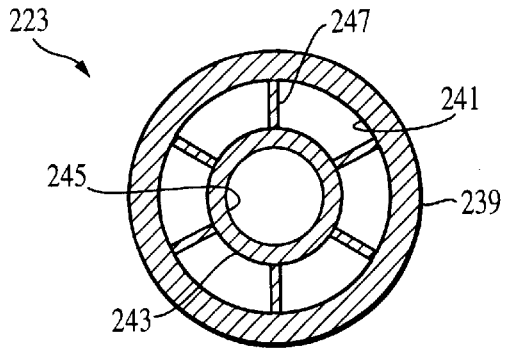
FIG. 16 is a cross-sectional view of a coaxial tube used in the heat exchanger of FIG. 14 taken along line 7—7.
Figure 17:
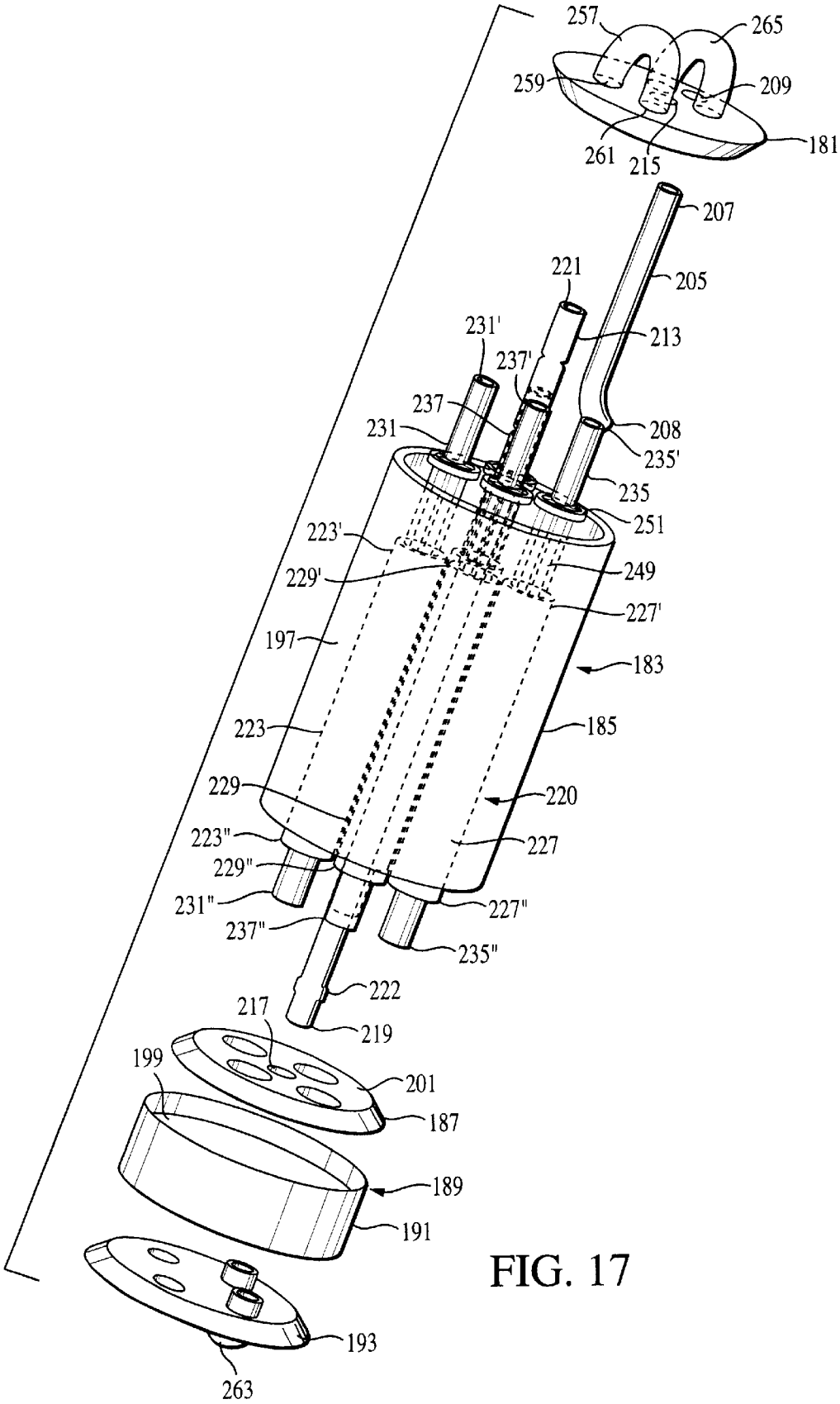
FIG. 17 is an exploded view of the accumulator of FIG. 14.

A third embodiment of the accumulator is shown in FIGS. 14–17. The accumulator 180 has a top 181, an upper housing 183 with sidewalls 185, a separator 187, a lower housing 189 with sidewalls 191, and a bottom 193. The top, upper housing, separator, lower housing, and bottom form a fluid tight or sealed internal chamber having an upper chamber 197 and a lower chamber 199. The separator 187 further has an upper surface 201, which forms the bottom of the upper chamber, and a lower surface 203, which forms the top of the lower chamber 199. Welding, brazing, soldering or any other suitable method may be used to join the top, the upper housing, the separator, the lower housing and the bottom to form the accumulator. The accumulator may have any shape, but is preferably cylindrical in shape as shown in FIGS. 14, 15, and 17. The top, upper housing, separator, lower housing, and bottom, may be formed from any material that will satisfy the structural demands placed on the accumulator. Suitable materials include, but are not limited to, aluminum, stainless steel, and copper. In a preferred embodiment, the top, upper housing, separator, lower housing and bottom are aluminum.

As shown in FIG. 17, a low pressure inlet port 205 has an upper end 207 and a lower end 208. The upper end 207 passes through an opening 209 in top of the housing and allows refrigerant flowing from the evaporator to enter the upper chamber of the accumulator housing. The lower end 208 may be slightly curved to direct the flow of refrigerant into the accumulator. Alternatively, the low pressure inlet port 205 may pass through an opening 211 in the sidewall 185 of the housing as shown in FIG. 14. The low pressure inlet port may have any desired shape, and maybe formed from aluminum, stainless steel, copper or any other suitable material. Preferably, the low pressure inlet port is a cylindrical aluminum tube.

As shown in FIGS. 14, 15 and 17, a vapor conduit 213 passes through an opening 215 in the center of the top down into the upper chamber, and through an opening 217 in the separator, and terminates in the lower chamber. The vapor conduit 213 has an inlet end 219, an outlet end 221, and a bead 222 formed adjacent the inlet end. The bead 222 abuts the lower surface of the separator and forms a fluid tight seal between the vapor conduit tube and the lower surface of the separator. In the embodiment shown in FIG. 14, the inlet end of the vapor conduit 213 abuts the bottom 193 such that a vapor tight seal is formed. As a result, the vapor conduit has a first opening 214 directly beneath the separator. Low pressure, low temperature vapor deposited in the lower chamber enters the vapor conduit through opening 214 and flows out of the accumulator at the outlet end 221 of the vapor conduit. A second opening 216 is formed in the vapor conduit directly above the separator. The opening 216 allows oil, which is collected and stored in the upper chamber, to flow into the vapor conduit where it mixes with the refrigerant and provides lubrication for the compressor and other parts of the overall system.

In another embodiment shown in FIG. 15, the inlet end 219 of the vapor conduit terminates above the bottom 193. Low pressure, low temperature vapor in the lower chamber flows into the inlet end 219 of the vapor conduit. Oil stored in the upper chamber enters the vapor conduit through an opening (not shown) in the conduit directly above the separator. The vapor conduit is preferably a cylindrical aluminum tube, but may have any desired shape, and may be formed from other suitable materials including stainless steel and copper.

Accumulator 180 further has a heat exchanger disposed primarily in the upper chamber. A preferred embodiment of the heat exchanger comprises four coaxial tubes generally represented at 220. Each coaxial tube is extruded and comprises an outer tube 223, 225, 227 and 229 with an open upper end 223', 225', 227' and 229', an open lower end 223", 225", 227", and 229", and an inner tube 231, 233, 235, and 237 with a corresponding upper end 231', 233', 235', and 237', and a lower end 231' 233" 235" and 237".

FIG. 16 is a cross-sectional view of one of the coaxial tubes. The cross-section of each coaxial tube is identical; therefore, for purposes of simplicity, only one coaxial tube will be described in detail. The outer tube 223 has an outer wall 239 and an inner wall 241, and the inner tube 231 has an outer wall 243 and an inner wall 245. Fins or separators 247 extend radially from the outer wall 243 of the inner tube to the inner wall 241 of the outer tube. Any number of fins may be used to separate the inner and outer tubes. The inner and outer tubes as well as the fins may be formed from aluminum, copper, or stainless steel or any other suitable material.

Referring now to FIGS. 14, 15, and 17, when the coaxial tubes 220 are extruded, inner tube and outer tube are the same length. Subsequently, as shown with respect to one coaxial tube, a portion of each end of the outer tube 223 and the fins 247 are machined off such that lower end 231'" and upper end 231' of the inner tube 231 extend beyond the lower and upper ends 223" and 223' of the outer tube 223. In addition, at the upper end of the outer tube 223, a second portion of the outer tube is machined off leaving an exposed portion 249 of the inner tube 231 and a ring 251 of outer tube 223. Ring 251 functions as a stopper to prevent the coaxial tube from sliding up and down in the accumulator housing and assists in securing the coaxial tube to the lower surface 255 of the top. The coaxial tubes may be attached to the top by brazing, welding, soldering or any other suitable method.

Each coaxial tube is positioned in the accumulator housing in the same manner. For example, inner tube 231 extends through the top, into upper chamber, through the separator, through the lower chamber, and exits bottom of the accumulator. In contrast, outer tube 223, extends from beneath the lower surface 255 of the top through the separator and terminates in the lower chamber directly below the separator 187.

The lower end 231" of the inner tube 231 functions as the high pressure inlet port, and the lower end 233" of the inner tube 233 functions as the high pressure outlet port for the accumulator. Preferably, inner tubes 231, 233, 235 and 237 are serially connected to from a continuous conduit for the flow of high pressure, high temperature refrigerant through the heat exchanger. To that end, as shown in FIG. 14, the upper end 231' of inner tube 231 is connected to the upper end 237' of inner tube 237 by a jumper 257. The jumper 257 is generally a U-shaped cylinder having a first end 259 and a second end 261 for receiving inner tubes 231' and 237' respectively. The diameter of the jumper 257 is generally slightly greater than the diameter of the inner tubes of 231' and 237' such that the tubes are inserted into the first and second ends of the jumper and matingly engaged. The jumper may be formed from aluminum, stainless steel, copper, or any other suitable material. The jumper 257 is preferably formed from aluminum. Welding, brazing, or soldering may be used to securely connect the jumper to the inner tubes. The lower end 237" of inner tube 237 is connected to the lower end 235" of inner tube 235 with a jumper 263 identical in all respects to the jumper 257. Upper end 235' of inner tube 235 is connected to upper end 233' of inner tube 233 with a jumper 265.

While the inner tubes of the heat exchanger are preferably serial connected, they may also be connected in a parallel arrangement. Such an arrangement allows for two different high temperature fluids to be cooled. For example, the upper end 231' may be connected to the upper end 237' by a jumper such that the lower ends 231" and 237" function as an inlet and outlet ports. Similarly, the upper ends 233' and 235' may be connected by a jumper such that the lower ends 233" and 235" function as inlet and outlet ports.

In operation, the accumulator 180 is positioned in an air conditioning or refrigeration system as shown in FIG. 1. Again, familiarity with the general flow of refrigerant through such a system is presumed. Arrows have been added to FIGS. 14 and 15 to indicate the direction of the flow of refrigerant through the accumulator and heat exchanger. High pressure, high temperature liquid refrigerant exits a condenser and enters lower end 231" of inner tube 231 and flows through all four serially connected inner tubes and is discharged through lower end 233" of inner tube 233 to the expansion device. At the same time, low pressure, temperature refrigerant from the evaporator enters inlet port 205 and flows into the upper chamber 197 of the housing. Liquid refrigerant flows to the bottom of the upper chamber where it is stored. Gaseous refrigerant rises and enters the upper ends 223', 225' 227' and 229' of the outer tubes. The gaseous refrigerant flows down the outer tubes in a heat exchange relationship with the high pressure, high temperature refrigerant flowing through the inner tubes, and is discharged into the lower chamber 199. The gaseous refrigerant then flows into the inlet end 219 of the vapor conduit 213 and flows in an upward direction and exits the accumulator at the upper end 221 of the vapor conduit and flows back to the compressor.

While the invention with its several embodiments has been described in detail, it should be understood that various modifications may be made to the present invention without departing from the scope of the invention. The following claims, including all equivalents define the scope of the invention.

What is claimed is:

1. An accumulator for an air conditioning or refrigeration system comprising:

a housing, said housing comprising an upper portion and a lower portion joined together to form a chamber;

a high pressure inlet port for conveying a high pressure refrigerant from a condenser into the accumulator;

a high pressure outlet port for discharging the high pressure refrigerant from the accumulator to an evaporator;

a low pressure inlet port for conveying low pressure refrigerant from an evaporator into the accumulator;

a low pressure outlet port for discharging the low pressure refrigerant from the accumulator to a compressor; and a vapor conduit tube for conveying the low pressure refrigerant in the accumulator to a heat exchanger disposed in the chamber, said heat exchanger comprising at least one tube having an interior, a internal end, an external end, at least one low temperature channel, and at least one high temperature channel, each channel extending through the interior of the tube, wherein the external end of the high temperature channel is connected to the high pressure inlet port, the external end of the low temperature channel is connected to the low pressure outlet port, the internal end of the low temperature channel is connected to the vapor conduit tube, and the internal end of the high temperature channel is connected to the high pressure outlet port.

2. The accumulator of claim 1 wherein the housing is cylindrical.

3. The accumulator of claim 1 wherein the heat exchanger is spirally wound and the internal end is located interiorly in the spiral.

4. The accumulator of claim 1 further comprising a deflector positioned within said housing.

5. The accumulator of claim 4 wherein the deflector is dome shaped.

6. The heat exchanger of claim 1 wherein said high temperature and said low temperature channels comprise adjacent rows of microchannels.

7. The heat exchanger of claim 1 wherein the refrigerant flows through the low temperature channel in a direction opposite the flow of refrigerant through the high temperature channel.

8. An accumulator for an air conditioning or refrigeration system comprising:

a hollow housing having a top and a bottom joined together to form a closed chamber; and a heat exchanger disposed in the housing, said heat exchanger comprising at least one tube defining at least one high temperature channel therethrough, and at least one low temperature channel therethrough, wherein a refrigerant discharged from a condenser enters the accumulator and flows through the high temperature channel before being discharged to an evaporator, and a refrigerant discharged from the evaporator enters the accumulator and flows through the low temperature channel in a heat exchange relationship with refrigerant flowing through the high temperature channel before being discharged to a compressor.

9. The accumulator of claim 8 wherein the refrigerant flowing through the high temperature channel flows in the opposite direction of the refrigerant flowing through the low temperature channel.

10. The accumulator of claim 8 further comprising a deflector positioned in said housing.

11. The heat exchanger of claim 8 wherein the said high temperature and said low temperature channels comprise adjacent rows of microchannels.

12. A method of operating an air conditioning or refrigeration cycle comprising:

conveying condensed refrigerant into an accumulator having an internal heat exchanger, said heat exchanger comprising at least one tube defining at least one high temperature channel therethrough and at least one low temperature channel therethrough, conveying the condensed refrigerant through the high temperature channel of the heat exchanger;

discharging refrigerant from the high temperature channel and accumulator;

evaporating the refrigerant;

conveying the evaporated refrigerant through a vapor conduit tube positioned in the accumulator and into the low temperature channel to flow in a heat exchange relationship with refrigerant flowing through the high temperature channel;

discharging the evaporated refrigerant from the low temperature channel and accumulator; and conveying the discharged evaporated refrigerant to a compressor.

13. The method of claim 12 wherein the low temperature and high temperature channels comprise a plurality of microchannels.

14. A method of cooling a high temperature liquid refrigerant in an air conditioning or refrigeration system comprising:

conveying the high temperature refrigerant through a heat exchanger disposed in an accumulator while simultaneously conveying a low temperature refrigerant through the heat exchanger, said heat exchanger comprising at least one tube defining at least one high temperature channel therethrough, and at least one low temperature channel therethrough, wherein the high temperature refrigerant flows through the high temperature channel in a heat exchange relationship with low temperature refrigerant flowing through the low temperature channel.

* * * * *